US006588544B2

(12) United States Patent
Fox

(10) Patent No.: US 6,588,544 B2
(45) Date of Patent: Jul. 8, 2003

(54) SPEAKER BOX WITH MOLDED PLASTIC END CAPS

(76) Inventor: Joseph C. Fox, 500 Mahler St., Houma, LA (US) 70363

( * ) Notice: Subject to any disclaimer, the term of this patent is extended or adjusted under 35 U.S.C. 154(b) by 0 days.

(21) Appl. No.: 09/923,123

(22) Filed: Aug. 6, 2001

(65) Prior Publication Data

US 2003/0024764 A1 Feb. 6, 2003

(51) Int. Cl.[7] ..... A47B 81/00
(52) U.S. Cl. ..... 181/199; 181/148; 181/156
(58) Field of Search ..... 181/199, 150, 181/151, 153, 156, 144, 146, 148

(56) References Cited

U.S. PATENT DOCUMENTS 3,746,125 A * 7/1973 Hammes ..... 181/150
4,891,842 A * 1/1990 Green ..... 181/150

* cited by examiner

*Primary Examiner*—Khanh Dang
(74) *Attorney, Agent, or Firm*—Wyatt, Tarrant & Combs, LLP

(57) ABSTRACT

A speaker box is comprising a hollow enclosure having opposing open ends, a molded plastic end cap acoustically sealing each of the open ends of the enclosure, and each end cap having at least one lengthwise reinforcement rib formed across a surface thereof to thereby substantially prevent the end cap from flexing under acoustic pressure. Each end cap preferably has a pair of reinforcement ribs formed on an inner surface of the end cap. The reinforcement ribs preferably intersect one another and taper upward toward the center of the end cap. The reinforcement ribs preferably extend substantially perpendicularly from the end cap. The end caps preferably have a recessed portion that recesses toward an inner surface of the end cap. An outer lip of the recessed portion provides additional rigidity to the end cap.

16 Claims, 3 Drawing Sheets

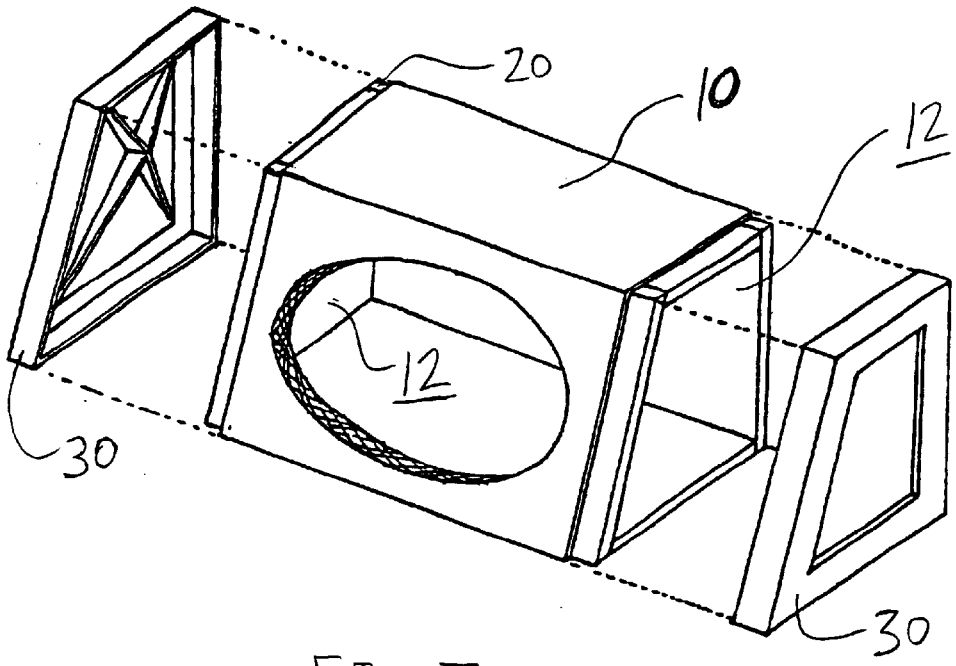
FIG. 7
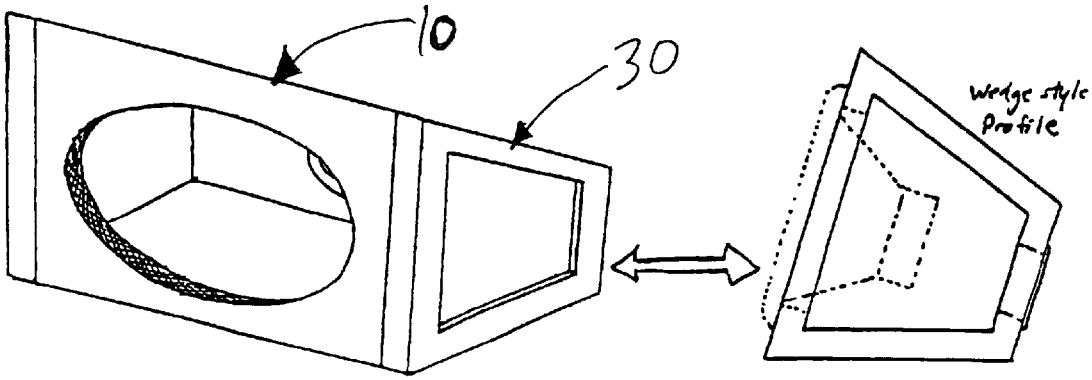
FIG. 8
FIG. 9

SPEAKER BOX WITH MOLDED PLASTIC END CAPS

STATEMENT REGARDING FEDERALLY SPONSORED RESEARCH OR DEVELOPMENT

Not Applicable

FIELD OF THE INVENTION

The present invention relates to speaker boxes, and more particularly to a speaker box with molded plastic end caps having reinforcement ribs. The reinforcement ribs allow the plastic end caps to remain substantially rigid and non-flexible under the acoustic pressures encountered in speaker boxes.

BACKGROUND OF THE INVENTION

Speaker box enclosures are typically made of particle board or other wood products. Particle board is a particularly favored material for speaker boxes because it is inexpensive, is easy to work with, and has good acoustic qualities. A speaker box enclosure has six sides, all of which are made of particle board. The intersections of the six sides of the box are held together by glue. A fastening means, such as staples or nails, can be used to hold the sides of the box together while the glue is drying. The outer surfaces of the speaker box are covered with an automotive grade carpet. The speaker box is provided with a baffle opening for holding a speaker and terminal cup opening for holding a terminal cup.

Although particle board is a relatively inexpensive material, the process of constructing a speaker box from particle board can be time consuming. In order to construct a box, six pieces of particle board must be cut to the dimensions of the box. Glue must be placed at appropriate edges of the six boards, and the boards must be joined together in the shape of the speaker box and secured in place while the glue dries. Carpet is then added to the outer surface of the six sides of the box. The process of cutting, fitting, and finishing carpet can be time consuming, and thus adds to the cost of producing speaker boxes.

During the past year or so, a speaker box having plastic end caps was temporarily placed on the market. However, the plastic end caps flexed during use. The flexing of the end caps reduced the ability of the caps to absorb sound pressure, reduced sound energy, and lowered the sound quality of the speaker box. Perhaps for the foregoing reasons, the speaker box with plastic end caps was pulled off of the market.

There is thus a need for a speaker box end having the following characteristics and advantages over the prior art.

OBJECTS AND SUMMARY OF THE INVENTION

It is an object of the invention to provide a speaker box that is economical to manufacture.

It is another object of the invention to provide a speaker box that reduces the amount of time required for manufacture.

It is another object of the invention to provide a molded plastic end cap that is inexpensive to manufacture and that can be readily attached to the ends of a speaker box.

It is yet another object of the invention to provide a molded plastic end cap that is designed to prevent flexing of the end cap under the acoustic pressures encountered in speaker boxes.

It is still another object of the invention to provide a speaker box that meets the foregoing objectives yet provides superior sound quality.

These and other objects and advantages of the invention shall become apparent from the following general and preferred description of the invention.

Accordingly, a speaker box is provided comprising, generally, a hollow enclosure having opposing open ends, a molded plastic end cap acoustically sealing each of the open ends of the enclosure, and each end cap having at least one lengthwise reinforcement rib formed across a surface thereof to thereby substantially prevent the end cap from flexing under acoustic pressure. Each end cap preferably has a pair of reinforcement ribs. The reinforcement ribs are preferably formed on an inner surface of the end cap. The reinforcement ribs preferably intersect one another, the intersection preferably being in a center of the end cap. The reinforcement ribs preferably taper upward toward the center of the end cap. The reinforcement ribs preferably extend substantially perpendicularly from the end cap. The end caps preferably have a recessed portion that recesses toward an inner surface of the end cap. An outer lip of the recessed portion provides additional rigidity to the end cap.

The enclosure is preferably formed of particle board, and preferably has four walls. An outer surface of the enclosure is preferably covered with automotive grade carpet. The enclosure preferably includes a baffle opening formed through one of the walls for holding a speaker in the enclosure, and a terminal cap opening formed through another of the walls for holding a terminal cap in the enclosure. A recessed rim is preferably formed on an outer surface of the enclosure around each open end. The end caps may be provided with an inwardly extending rim sized to engage the recessed rim of the enclosure.

BRIEF DESCRIPTION OF THE DRAWINGS

FIG. 7 is a front-side perspective view of one preferred embodiment of a speaker box of the invention, featuring a truck style profile and an exploded view of one preferred embodiment of an end cap engagement with the speaker box enclosure.

FIG. 8 is a front perspective view of one preferred embodiment of a speaker box of the invention, featuring a wedge profile.

FIG. 9 is a side cross-section view of one preferred embodiment of a speaker box of the invention, featuring a wedge profile.

PREFERRED EMBODIMENTS OF THE INVENTION

In the following detailed description of the preferred embodiments, reference is made to the accompanying drawings which form a part hereof, and in which are shown by way of illustration specific embodiments in which the invention may be practiced. It is to be understood that other embodiments may be utilized and structural changes may be made without departing from the scope of the present invention.

Figure 1:
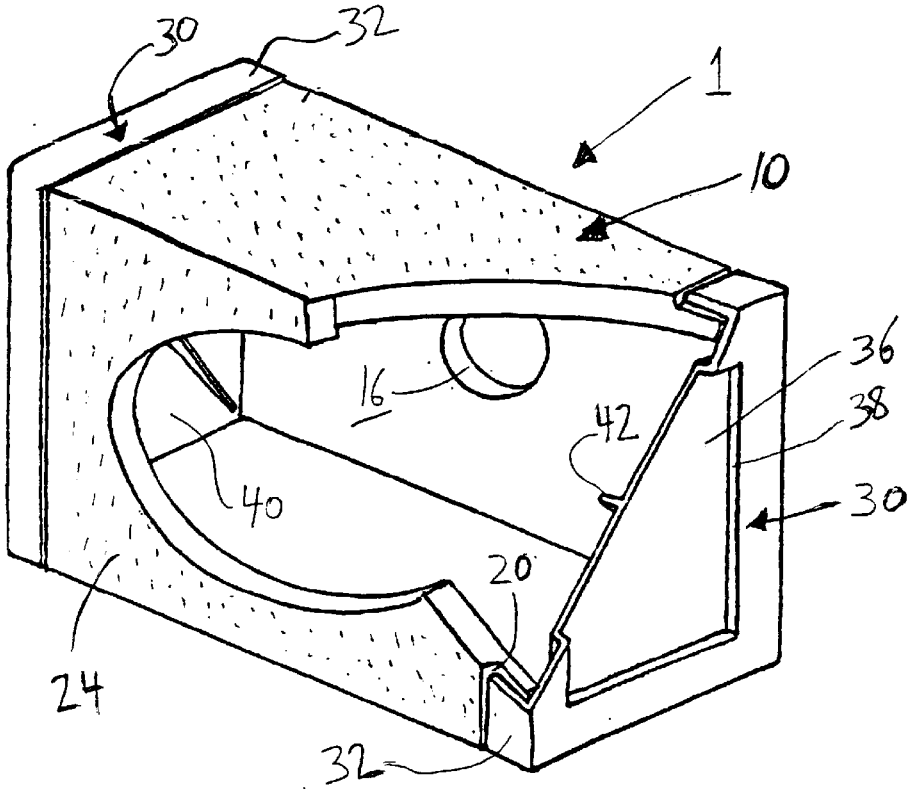
FIG. 1 is a front-side perspective view of one preferred embodiment of a speaker box of the invention, featuring a square profile a partial cutaway view of an interior of the speaker box.
Figure 2:
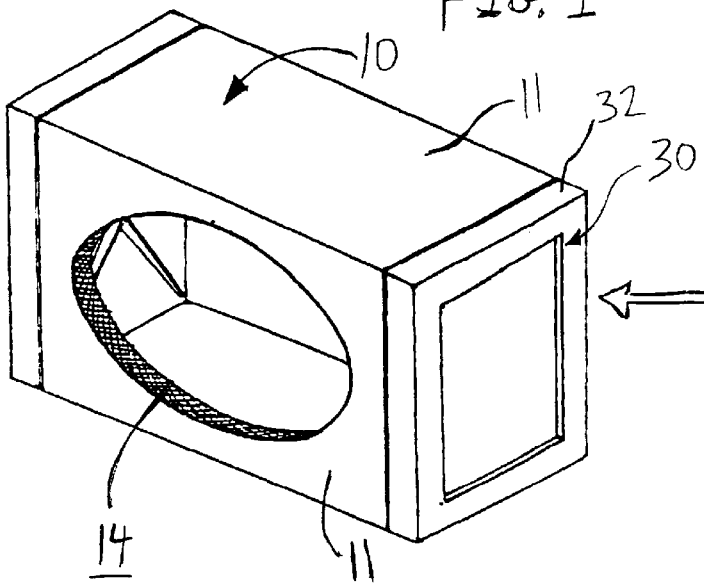
FIG. 2 is a front perspective view of one preferred embodiment of a speaker box of the invention, featuring a square profile.

As shown in FIG. 1, the speaker box of the invention 1 comprises, generally, a hollow enclosure 10 having opposing open ends 12, a molded plastic end cap 30 acoustically sealing each of the open ends 12 of the enclosure 10, and at least one lengthwise reinforcement rib 42 formed across a surface of each end cap 30. The reinforcement rib 42 substantially prevents the end cap 30 from flexing under acoustic pressure, including particularly the acoustic pressures encountered in speaker boxes.

Figure 4:
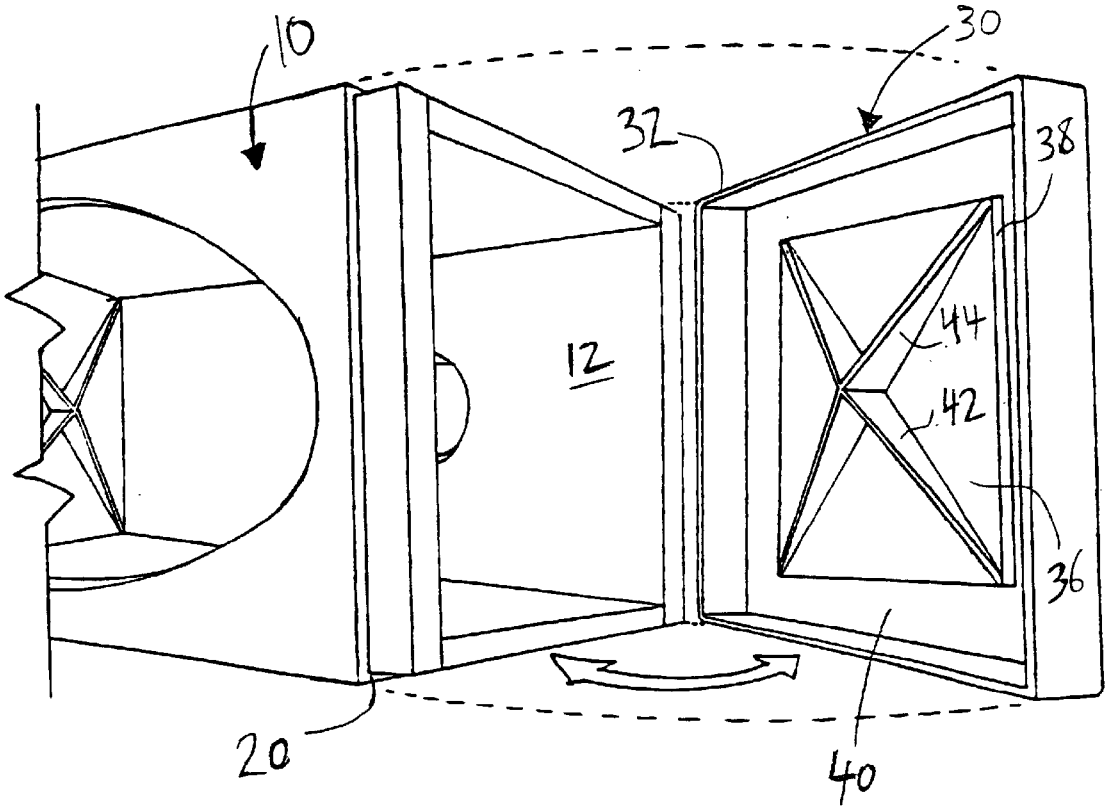
FIG. 4 is a front-side perspective view of one preferred embodiment of a speaker box of the invention, featuring a square profile and an exploded view of one preferred embodiment of an end cap engagement with the speaker box enclosure.
Figure 5:
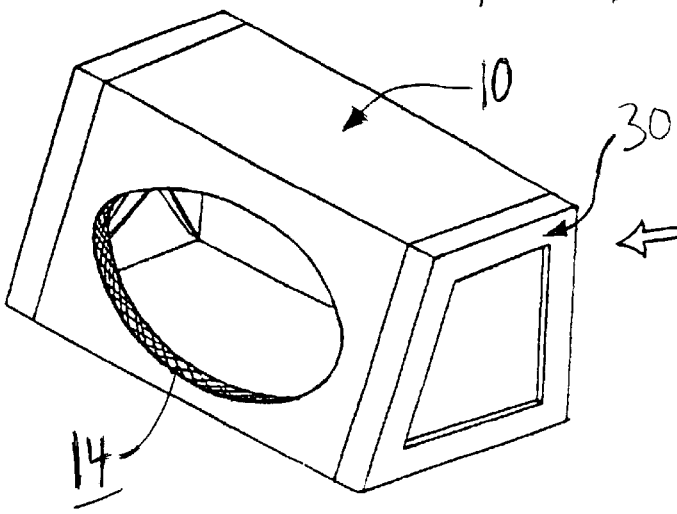
FIG. 5 is a front-side perspective view of one preferred embodiment of a speaker box of the invention, featuring a truck style profile.

As shown most clearly in FIG. 4, each end cap 30 preferably has a pair of the reinforcement ribs 42, 44. The ribs 42, 44 are preferably molded as an integral part of the end cap 30, but the ribs 42, 44 can alternatively be attached to the end cap 30 after the molding process, such as by glue. The reinforcement ribs 42, 44 can be formed on either the inner 40 or outer surface of the end cap 30. However, as shown in FIG. 4, the reinforcement ribs 42, 44 are preferably formed on an inner surface of the end cap 30, for aesthetic reasons and to prevent the ribs 42, 44 from being damaged.

As shown in FIG. 4, the reinforcement ribs 42, 44 preferably intersect one another so as to provide support in two dimensions. As shown in FIG. 4, the reinforcement ribs 42, 44 preferably intersect one another at substantially a center of the end cap 30. The reinforcement ribs 42, 44 also preferably taper upward toward the center of the end cap 30, as shown in FIG. 4. The ribs 42, 44 shown in FIGS. 1 and 4 have a flat or linear profile, such that the ribs 42, 44 extend substantially perpendicularly from the end cap 30. Alternatively, the ribs 42, 44 can be molded to have various other profiles, such as triangular, semicircular, or square.

Figure 3:
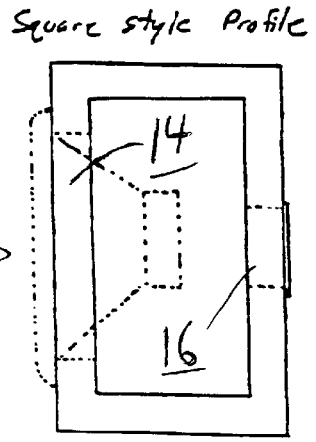
FIG. 3 is a side cross-section view of one preferred embodiment of a speaker box of the invention, featuring a square profile.
Figure 6:
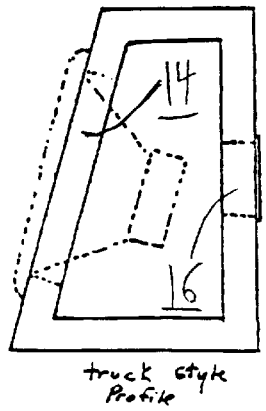
FIG. 6 is a side cross-section view of one preferred embodiment of a speaker box of the invention, featuring a truck style profile.

In a preferred embodiment, the enclosure 10 has four walls 11. The walls 11 are preferably sized and arranged so as to form one of the standard speaker box profiles: square (FIG. 3); truck (FIG. 6); or wedge (FIG. 9). The walls 11 of the enclosure 10 are preferably formed from sheets of particle board. An outer surface of the enclosure 10 is covered with automotive grade carpet 24, in a manner well known to those of skill in the speaker manufacturing art. The enclosure 10 is provided with a baffle opening 14 for holding a speaker in the enclosure 10. The enclosure is also provided with a terminal plug opening 16 for holding a terminal plug in the enclosure 10. Speaker boxes are typically sold without speakers and terminal plugs, so that purchasers can custom select these components. However, the speaker box of the invention 1 can be sold with or without the speaker and terminal plug components.

Each end cap 30 is sized and configured to seal the open ends 12 of the enclosure 10. In a preferred embodiment shown in FIG. 4, each end cap 30 has an inwardly extending rim 32. In a preferred embodiment shown most clearly in FIG. 4, a recessed rim 20 is formed on an outer surface of the enclosure 10 around each of the open ends 12. The rim 32 of the end cap 30 is sized to engage the recessed rim 20 of the enclosure 10. The recessed rim 20 allows the rim 32 of the end cap 30 to be countersunk along the outer surface of the enclosure 10.

As shown in FIG. 1, each end cap 30 preferably has a recessed portion 36. The recessed portion 36 recesses toward the inner surface 40 of the end cap. A lip 38 extends around the recessed portion 36 and provides additional rigidity to the end cap 30. The recessed portion 36 can be sized such that the inside lip 38 of the recessed portion 36 abuts tightly against the inner surface of the walls 11 of the enclosure 10.

A speaker box according to the invention 1 can be constructed using the following procedures. A hollow enclosure 10 is formed from particle board, the enclosure having four walls 11 and opposing open ends 12. The edges of the walls 11 are glued and/or stapled together in the conventional manner. The enclosure 10 preferably has a square, truck or wedge style profile (compare FIGS. 3, 6, and 9). An outer surface of the enclosure 10 is preferably covered with automotive grade carpet 24. A plastic molded end cap 30 is then glued onto each of the open ends 12 of the enclosure 10. A baffle opening 14 and a terminal cup opening 16 can be cut into the walls of the enclosure 10, in the conventional manner. If desired, a recessed rim 20 can be formed on the outer surface of the enclosure 10 around each open end 12, such that the end caps 30 countersink against the enclosure. The recessed rim 20 is preferably formed on the individual walls 11 before they are joined together to form the enclosure 10.

The foregoing process cuts out several steps in the conventional process for manufacturing speaker boxes. In the conventional process, two end walls are cut in order to plug the open ends 12 of the enclosure 10. The end walls are then fixed to the enclosure. Carpet is then fitted over the end walls. By incorporating molded plastic end caps 30, the invention 1 eliminates the time necessary to cut end walls and to cut, fit, and finish the carpeting on the end walls.

Speaker boxes come in a variety of sizes. The present invention is directed primarily to the standard 6 inch by 9 inch size speaker box. The invention can be used on larger or smaller speaker boxes, but it is expected that with increased size of the end caps 30, the reinforcement ribs 42, 44 will eventually be unable to adequately prevent flexing of the end caps 30.

In operation, the speaker box of the invention 1 is used in the same manner as conventional speaker boxes. A speaker is fitted into and secured in the baffle opening 14, a terminal cup is inserted into and secured in the terminal cup opening 16, the speaker is coupled to the terminal cup, and the terminal cup is coupled to a stereo or other hi-fi component.

Although the present invention has been described in terms of specific embodiments, it is anticipated that alterations and modifications thereof will no doubt become apparent to those skilled in the art. It is therefore intended that the following claims be interpreted as covering all alterations and modifications that fall within the true spirit and scope of the invention.

What is claimed is:

1. A speaker box comprising:

a hollow enclosure having opposing open ends, a molded plastic end cap acoustically sealing each of said open ends of said enclosure, each said end cap having a pair of lengthwise reinforcement ribs formed across and on an inner surface thereof to thereby substantially prevent said end cap from flexing under acoustic pressure, said reinforcement ribs intersecting one another at substantially a center of said end cap, said reinforcement ribs tapering upward toward said center of said end cap, said enclosure formed of particle board, and an outer surface of said enclosure covered with automotive grade carpet.

2. The speaker box of claim 1, further comprising said enclosure having a baffle opening and a terminal plug opening.

3. A speaker box comprising:

a hollow enclosure having opposing open ends, a molded plastic end cap acoustically sealing each of said open ends of said enclosure, each said end cap having at least one lengthwise reinforcement rib formed across a surface thereof to thereby substantially prevent said end cap from flexing under acoustic pressure, and a recessed portion formed on each said end cap, said recessed portion recessing toward an inner surface of said end cap, an outer lip of said recessed portion providing additional rigidity to said end cap.

4. The speaker box of claim 3, wherein each said end cap has a pair of said reinforcement ribs.

5. The speaker box of claim 4, wherein said reinforcement ribs are formed on an inner surface of said end cap.

6. The speaker box of claim 5, wherein said reinforcement ribs intersect one another.

7. The speaker box of claim 5, wherein said reinforcement ribs intersect one another at substantially a center of said end cap.

8. The speaker box of claim 7, wherein said reinforcement ribs taper upward toward said center of said end cap.

9. The speaker box of claim 5, wherein said reinforcement ribs extend substantially perpendicularly from said end cap.

10. The speaker box of claim 3, wherein said reinforcement ribs intersect one another at substantially a center of said end cap.

11. The speaker box of claim 3, wherein said reinforcement ribs extend substantially perpendicularly from said end cap.

12. A speaker box comprising:

a four walled hollow enclosure having opposing open ends, a recessed rim formed on an outer surface of said enclosure around each said open end, said walls of said enclosure formed from sheets of particle board, said outer surface of said enclosure covered with automotive grade carpet, said enclosure having a baffle opening formed through one of said walls for holding a speaker in said enclosure, said enclosure having a terminal cap opening formed through another of said walls for holding a terminal cap in said enclosure, a pair of molded plastic end caps, each said end cap sized and configured to seal said open ends of said enclosure, each said end cap having an inwardly extending rim sized to engage said recessed rim of said enclosure, each said end cap having a pair of intersecting reinforcement ribs formed across an inner surface thereof to thereby substantially prevent said end cap from flexing under acoustic pressure, and one of said end caps fixed to each said open end of said enclosure such that said end caps acoustically seal said open ends of said enclosure.

13. The speaker box of claim 12, wherein said reinforcement ribs taper upward toward said center of said end cap.

14. A method of constructing a speaker box comprising:

forming a hollow enclosure from particle board, said enclosure having four walls and opposing open ends, covering an outer surface of said enclosure with automotive grade carpet, providing a pair of molded plastic end caps, each said end cap sized and configured to seal said open ends of said enclosure, each said end cap having a pair of intersecting reinforcement ribs formed across an inner surface thereof to thereby substantially prevent said end cap from flexing under acoustic pressure, gluing one of said end caps onto each of said open ends of said enclosure to thereby acoustically seal said open ends of said enclosure.

15. The method of claim 14, further comprising cutting a baffle opening in one of said walls of said enclosure and cutting a terminal cup opening in another of said walls of said enclosure.

16. The method of claim 14, further comprising forming a recessed rim on said outer surface of said enclosure around each said open end, and each said end cap having an inwardly extending rim sized to engage said recessed rim of said enclosure.

* * * * *